US006247381B1

(12) United States Patent
Toelke et al.

(10) Patent No.: US 6,247,381 B1
(45) Date of Patent: Jun. 19, 2001

(54) ADJUSTABLE BRAKE, CLUTCH AND ACCELERATOR PEDALS

(75) Inventors: Steven Allen Toelke, Royal Oak; Gordon Lloyd Smith, Orion; Richard Scott Bigham, Kalkaska; Michael William DePotter, Berkley, all of MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 0 days.

(21) Appl. No.: 09/492,238

(22) Filed: Jan. 27, 2000

(51) Int. Cl.[7] ..... G05G 1/14
(52) U.S. Cl. ..... 74/512; 74/560
(58) Field of Search ..... 74/512, 513, 514, 74/560

(56) References Cited

U.S. PATENT DOCUMENTS

| | | | |
|---|---|---|---|
| 3,643,524 | 2/1972 | Herring . | |
| 3,643,525 | 2/1972 | Gibas . | |
| 3,975,972 | 8/1976 | Muhleck . | |
| 4,497,399 | 2/1985 | Kopich . | |
| 4,683,977 | 8/1987 | Salmon . | |
| 4,870,871 | 10/1989 | Ivan . | |
| 4,875,385 | 10/1989 | Sitrin . | |
| 4,989,474 | 2/1991 | Cicotte et al. . | |
| 5,010,782 | 4/1991 | Asano et al. . | |
| 5,078,024 | 1/1992 | Cicotte et al. . | |
| 5,351,573 | 10/1994 | Cicotte . | |
| 5,460,061 | 10/1995 | Redding et al. . | |
| 5,632,183 | 5/1997 | Rixon et al. . | |
| 5,697,260 | 12/1997 | Rixon et al. . | |
| 5,722,302 | 3/1998 | Rixon et al. . | |
| 5,771,752 | 6/1998 | Cicotte . | |
| 5,819,593 | 10/1998 | Rixon et al. . | |
| 5,823,064 | 10/1998 | Cicotte . | |
| 5,855,143 | 1/1999 | Ewing . | |
| 5,901,614 | 5/1999 | Ewing . | |
| 5,913,946 | 6/1999 | Ewing . | |
| 5,927,154 * | 7/1999 | Elton et al. | 74/512 |
| 5,996,438 * | 12/1999 | Elton | 74/512 |
| 6,019,015 * | 2/2000 | Elton | 74/512 X |
| 6,070,489 | 6/2000 | Ananthasivan et al. . | |

* cited by examiner

*Primary Examiner*—Mary Ann Green
(74) *Attorney, Agent, or Firm*—Porter, Wright, Morris & Arthur

(57) ABSTRACT

An adjustable control pedal for a motor vehicle includes an upper arm and a lower arm carrying a pedal and selectively movable relative the upper arm to adjust the position of the pedal. The upper arm has a vertically extending flat or planar portion and a substantially horizontal slot formed at the planar portion. A drive screw is secured to the upper arm and is laterally spaced apart from the planar portion generally parallel to the slot. A drive nut threadably engages the drive screw and moves axially along the drive screw upon rotation of the drive screw. A motor is connected to the drive screw to selectively rotate the drive screw in one direction or the other. The lower arm has a guide extending into the slot which is connected to the drive nut for linear fore-aft sliding movement of the guide along the slot upon rotation of the drive screw and resulting linear fore-aft movement of the pedal. The drive screw is secured to the upper arm through a first self-aligning ball/socket joint and the drive nut is secured to the lower arm through a second self-aligning ball/socket joint so that the drive screw and the drive nut automatically self align as the drive nut travels along the drive screw. The drive screw is preferably secured to the upper arm by a snap-fit connection.

34 Claims, 8 Drawing Sheets

FIG-5A
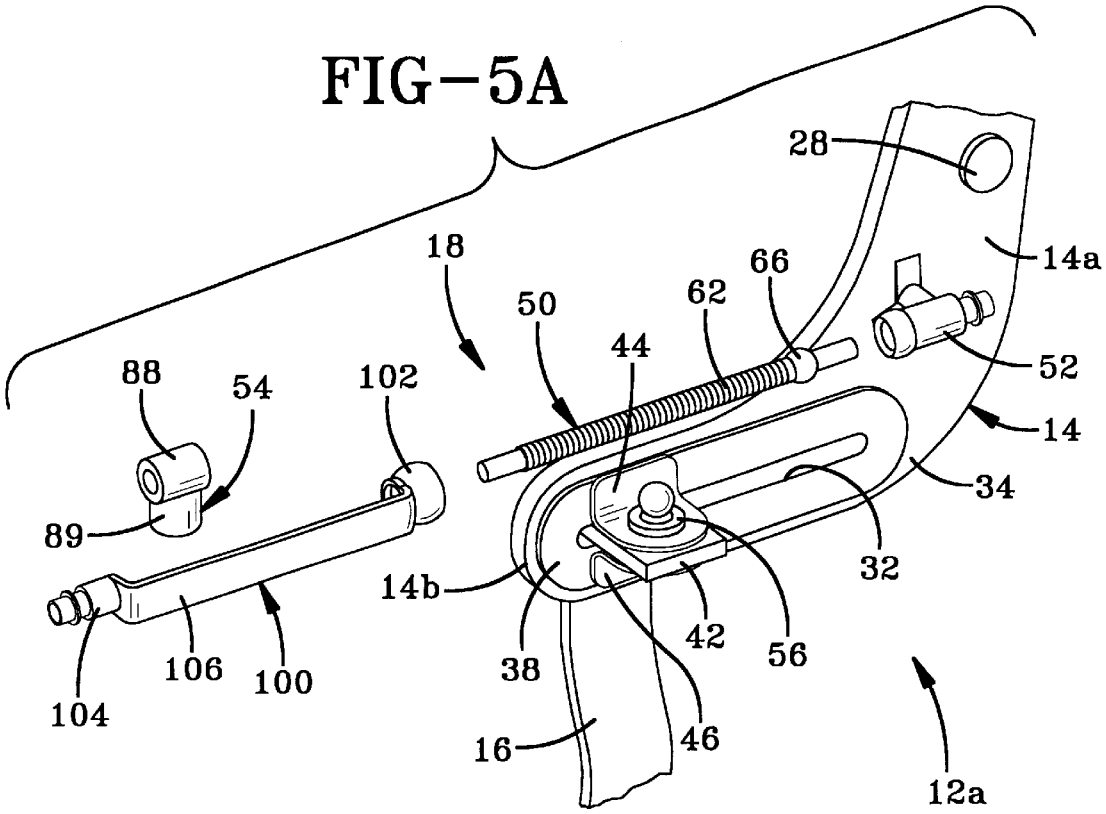
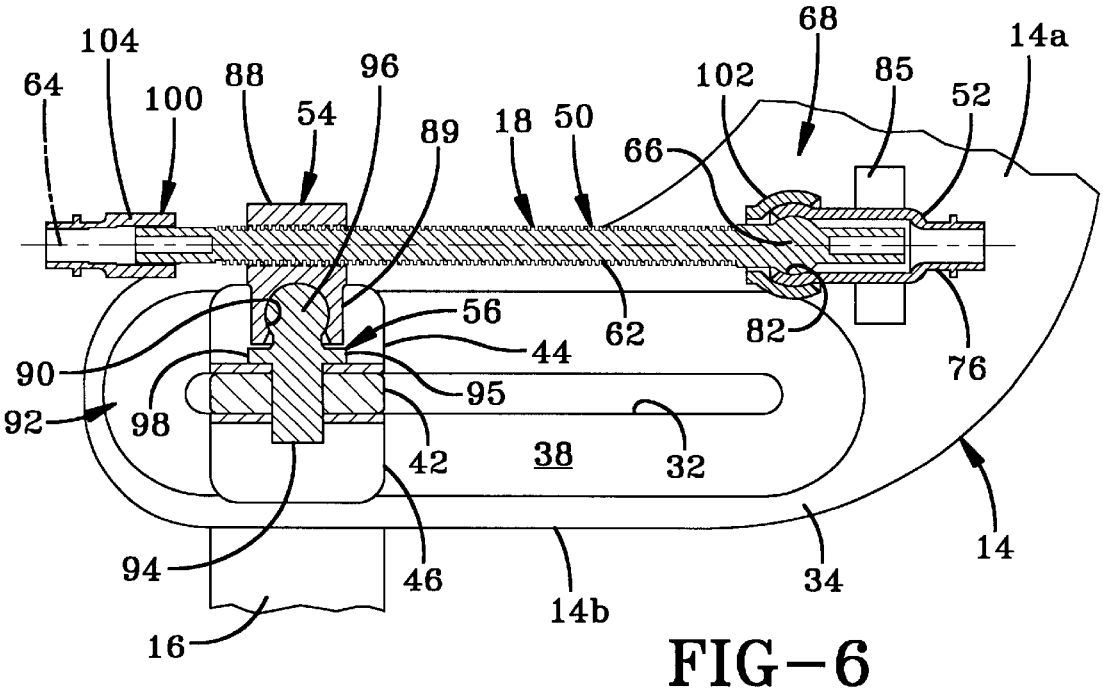
FIG-6

ADJUSTABLE BRAKE, CLUTCH AND ACCELERATOR PEDALS

FIELD OF THE INVENTION

The present invention generally relates to an improved control pedal for a motor vehicle and, more particularly, to a control pedal for a motor vehicle which is selectively adjustable to desired positions.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the front seat to the most advantageous position for working the control pedals.

This adjustment method of moving the front seat along the tracks generally fills the need to accommodate drivers of various size, but it raises several concerns. First, this adjustment method still may not accommodate all drivers due to very wide differences in anatomical dimensions of drivers. Second, the position of the seat may be uncomfortable for some drivers. Therefore, it is desirable to have an additional or alternate adjustment method to accommodate drivers of various size.

Many proposals have been made to selectively adjust the position of the control pedals relative to the steering wheel and the front seat in order to accommodate drivers of various size. It would be readily apparent to those skilled in the art that these adjustable control pedals can actuate both conventional cable controls and electronic throttle controls (ETC), because the ETC is a function separate from adjustability and the ETC module would typically be positioned remote from the mechanism for adjustment of the control pedals. U.S. Pat. Nos. 5,632,183, 5,697,260, 5,722,302, 5,819,593, 5,937,707, and 5,964,125, the disclosures of which are expressly incorporated herein in their entirety by reference, each disclose an example of an adjustable control pedal assembly. The control pedal assembly disclosed by these patents includes a hollow guide tube, a rotatable screw shaft coaxially extending within the guide tube, a nut in threaded engagement with the screw shaft and slidable within the guide tube, and a control pedal rigidly connected to the nut. The control pedal is moved forward and rearward when an electric motor rotates the screw shaft to translate the nut along the screw shaft within the guide tube. While this control pedal assembly may adequately adjust the position of the control pedal to accommodate drivers of various size, this control pedal assembly is relatively complex and expensive to produce. The relatively high cost is particularly due to the quantity of high-precision machined parts such as, for example, the guide tube and due to the quantity of welded joints. Accordingly, there is a need in the art for an adjustable control pedal which selectively adjusts the position of the pedal to accommodate drivers of various size, is relatively simple and inexpensive to produce, and is highly reliable operate.

SUMMARY OF THE INVENTION

The present invention provides an adjustable control pedal for a motor vehicle which overcomes at least some of the above-noted problems of the related art. According to the present invention, a control pedal includes an upper arm having a vertically extending planar portion and a generally horizontal slot at the planar portion. A screw is secured to the upper arm and is spaced apart from the planar portion. A nut threadably engages the screw and is adapted to move axially along the screw upon rotation of the screw. A motor is operatively connected to the screw to selectively rotate the screw. A lower arm has a pedal at a lower end and a guide extending into the slot. The guide is operatively connected to the nut for movement of the guide along the slot and linear fore aft movement of the pedal upon rotation of the screw.

According to another aspect of the present invention, a control pedal includes an upper arm and a screw secured to the upper arm. A nut threadably engages the screw and is adapted to move axially along the screw upon rotation of the screw. A motor is operatively connected to the screw to selectively rotate the screw. A lower arm is carried by the upper arm and has a pedal at a lower end. The lower arm is operatively connected to the nut for fore and aft movement of the pedal relative to the upper arm upon rotation of the screw. The screw is secured to the upper arm through a pivotable joint to align the screw and the nut for the axial movement of the nut along the screw. The pivotable joint is preferably adapted to allow the screw to freely pivot about a plurality of axes perpendicular to an axis of rotation of the screw such as, for example, a ball/socket joint so that the screw and the nut self align. The pivotable joint is also preferably adapted to be a snap-fit connection.

According to another aspect of the present invention, a control pedal includes an upper arm and a screw secured to the upper arm. A nut threadably engages the screw and is adapted to move axially along the screw upon rotation of the screw. A motor is operatively connected to the screw to selectively rotate the screw. A lower arm is carried by the upper arm and has a pedal at a lower end. The lower arm is operatively connected to the nut for fore and aft movement of the pedal relative to the upper arm upon rotation of the screw. The lower arm is connected to the nut through a pivotable joint to align the nut and the screw for the axial movement of the nut along the screw. The pivotable joint is preferably adapted to allow the screw to freely pivot about a plurality of axes perpendicular to an axis of rotation of the screw such as, example, a ball/socket joint so that the screw and the nut self align. The pivotable joint is also preferably adapted to be a snap-fit connection.

According to yet another aspect of the present invention, a control pedal includes an upper arm, a screw, and an attachment secured to the upper arm and supporting the screw. A nut threadably engages the screw and is adapted to axially move along the screw upon rotation of the screw. A motor is operatively connected to the screw to selectively rotate the screw. A lower arm is carried by the upper arm and has a pedal at a lower end. The lower arm is operatively connected to the nut for fore and aft movement of the pedal relative to the upper arm upon rotation of the screw. Either the upper arm or the attachment has an opening and the other has a protrusion extending into the opening which is adapted to allow insertion of the protrusion into the opening but to deny undesired withdrawal of the protrusion from the opening so that the attachment is secured to the upper arm without use of fasteners. Preferably, there is a snap-fit connection between the attachment and the upper arm.

From the foregoing disclosure and the following more detailed description of various preferred embodiments it will be apparent to those skilled in the art that the present invention provides a significant advance in the technology and art of control pedal assemblies. Particularly significant in this regard is the potential the invention affords for providing a high quality, feature-rich, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein:

FIG. 5A is an enlarged, fragmented perspective view of a portion of FIG. 3 showing a drive assembly of one of the control pedals of FIGS. 1–4, wherein the view is partially exploded and some components are removed for clarity;

FIG. 6 is an enlarged, fragmented elevational view, in cross section, of the drive assembly of FIG. 5A;

Figure 1:
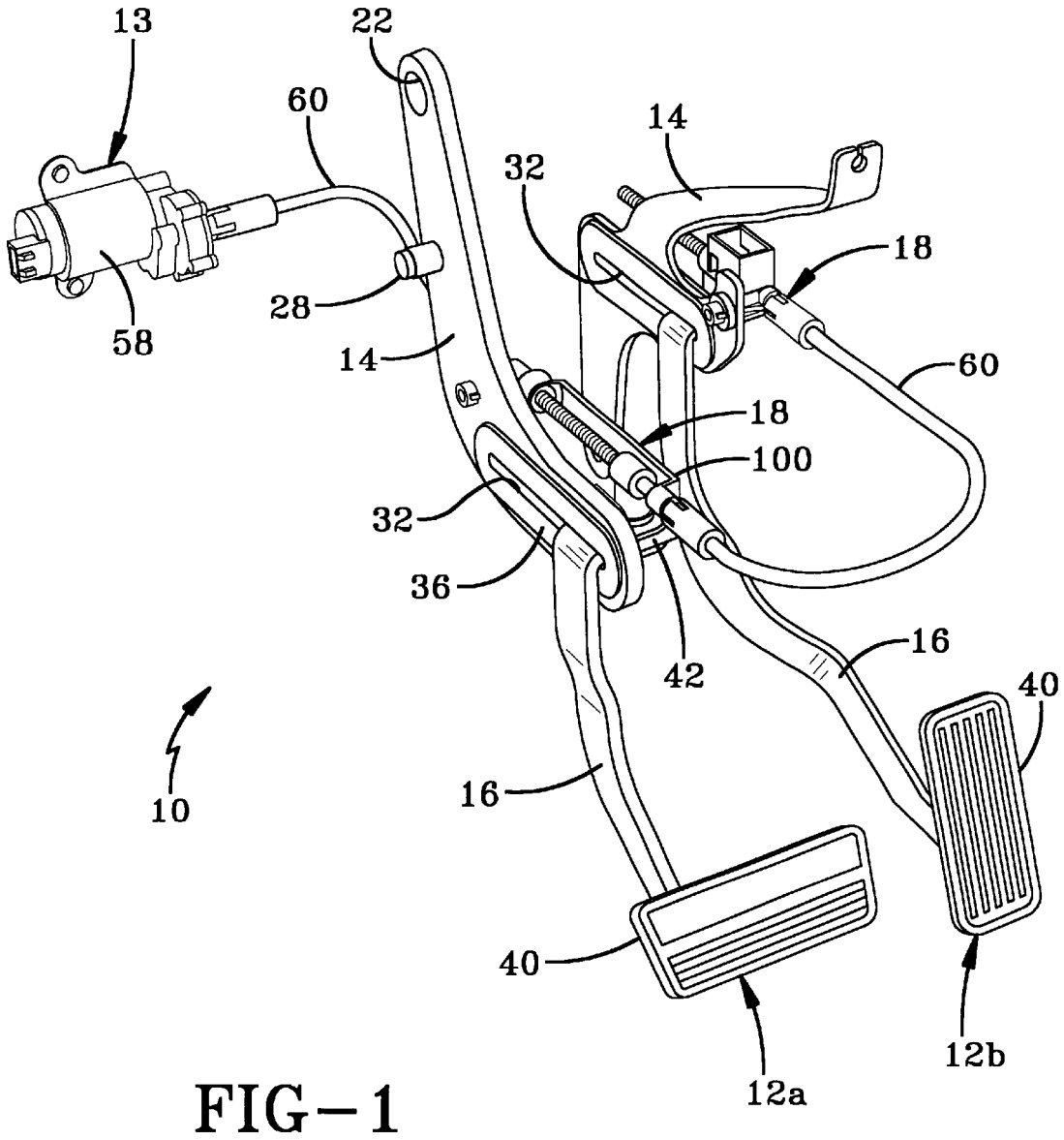
FIG. 1 is a perspective view of an adjustable control pedal assembly according to the present invention having two control pedals wherein each control pedal has a lower arm selectively movable relative to an upper arm along a horizontal slot provided in the upper arm.
Figure 2:
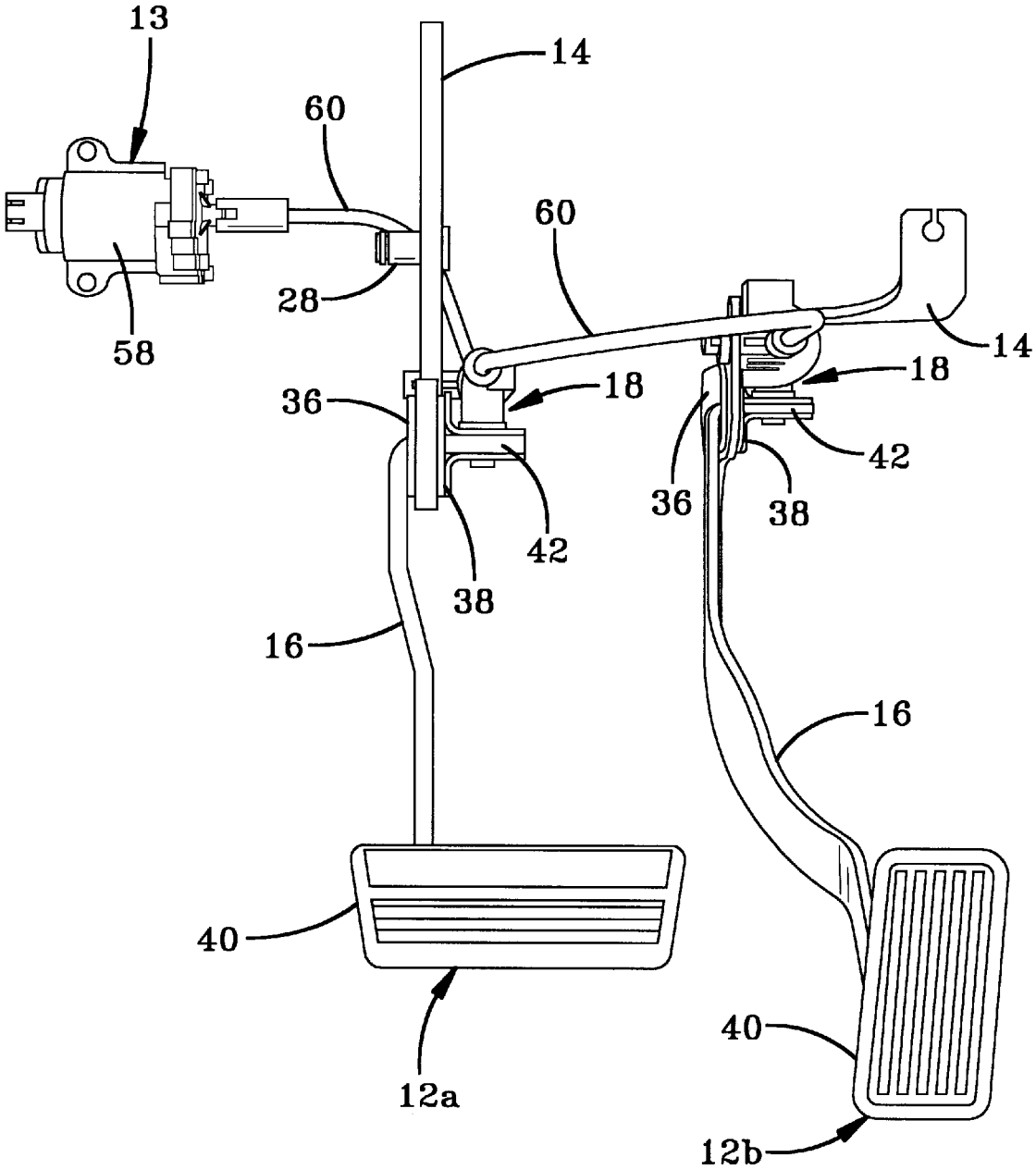
FIG. 2 is a rear elevational view of the adjustable control pedal assembly of FIG. 1.
Figure 3:
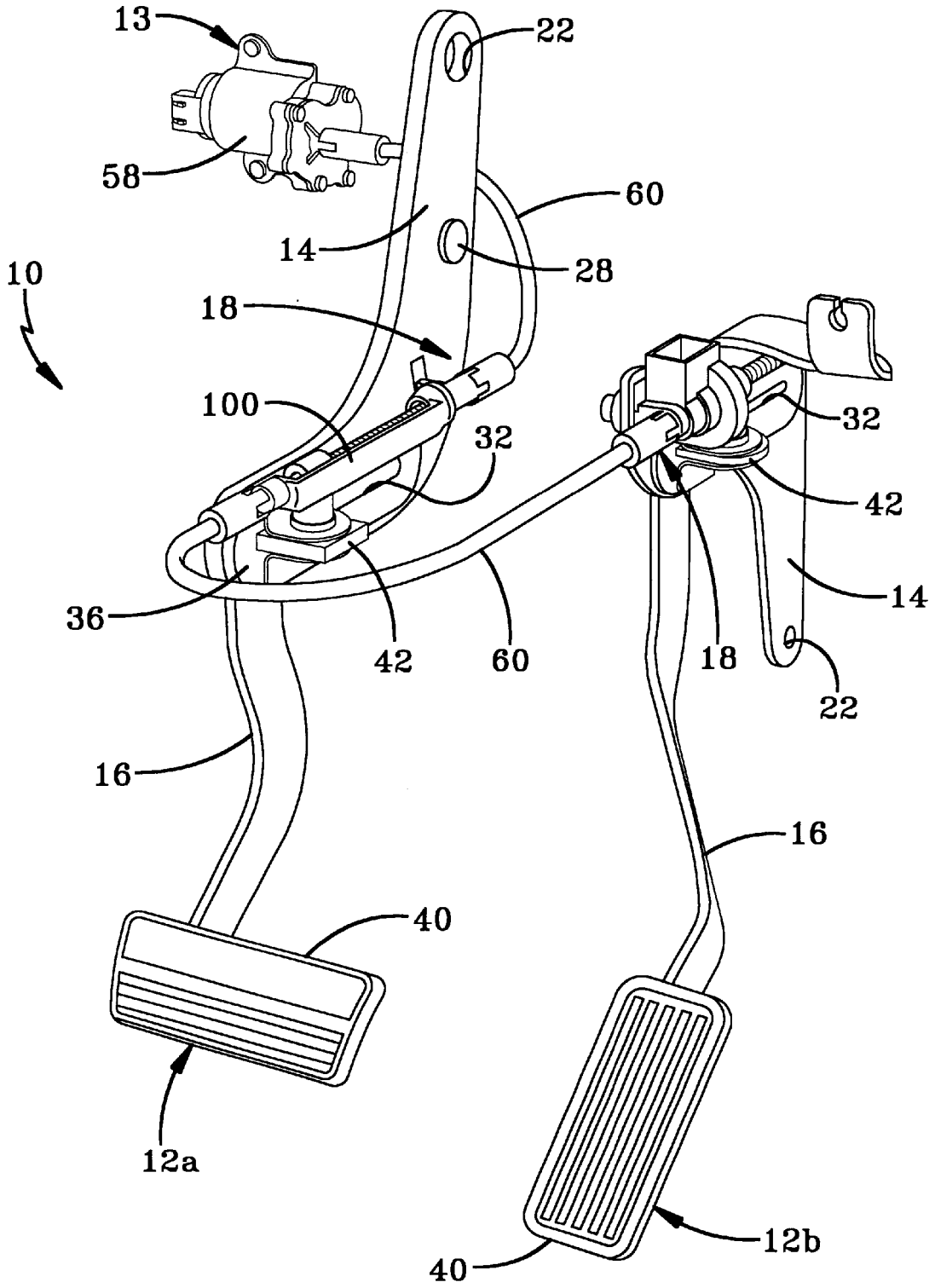
FIG. 3 is a perspective view of the adjustable control pedal assembly of FIGS. 1 and 2 showing the opposite side of FIG. 1.
Figure 4:
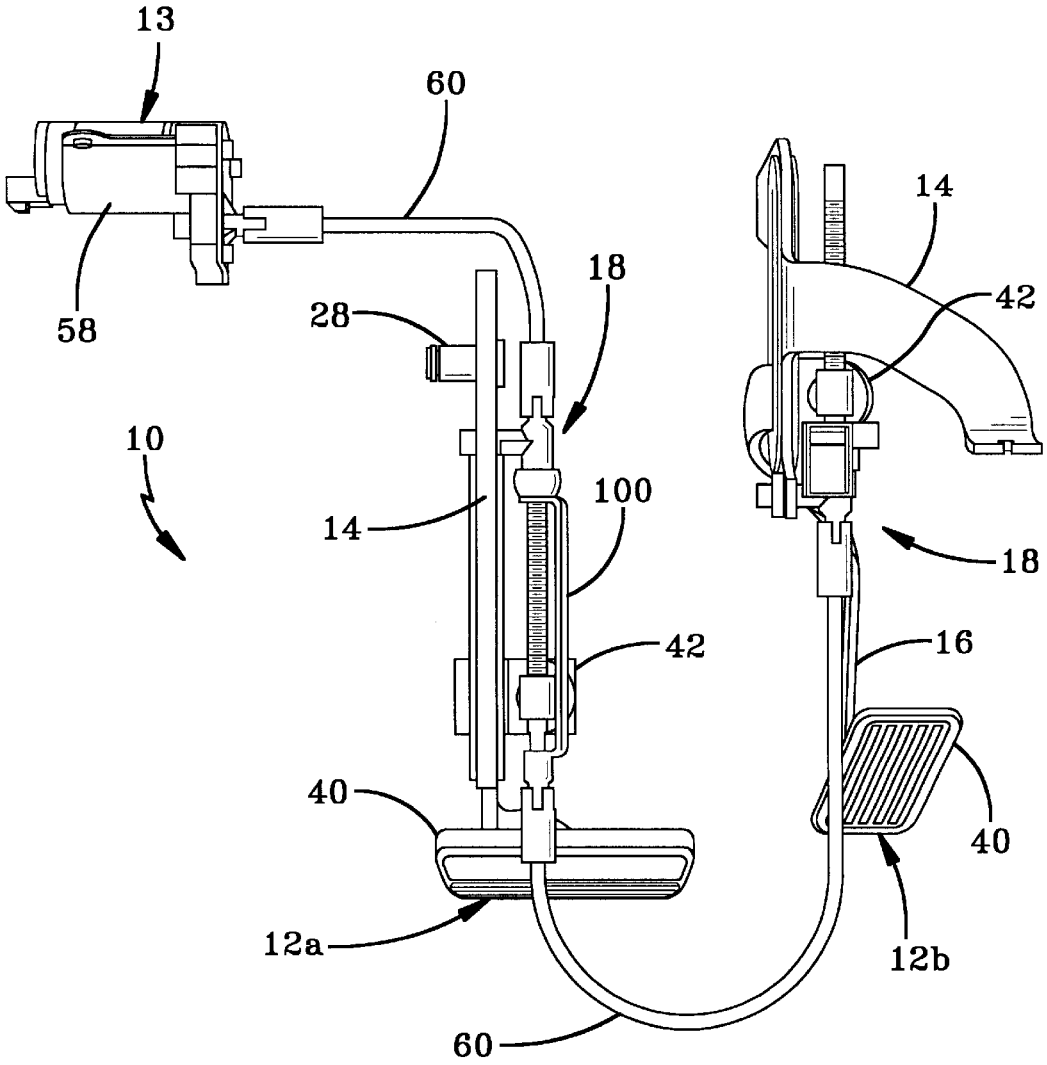
FIG. 4 is a top plan view of the adjustable control pedal assembly of FIGS. 1–3.

It should be understood that the appended drawings are not necessarily to scale, presenting a somewhat simplified representation of various preferred features illustrative of the basic principles of the invention. The specific design features of a control pedal assembly as disclosed herein, including, for example, specific dimensions of the upper and lower arms will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction in the plane of the paper in FIG. 1 and down or downward refers to a downward direction in the plane of the paper in FIG. 1. Also in general, fore or forward refers to a direction toward the front of the motor vehicle and aft or rearward refers to a direction toward the rear of the motor vehicle.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved control pedal assemblies disclosed herein. The following detailed discussion of various alternative and preferred embodiments will illustrate the general principles of the invention with reference to a control pedal assembly for use with a motor vehicle. Other embodiments suitable for other applications will be apparent to those skilled in the art given the benefit of this disclosure. The term "snap-fit connection" is used herein and in the claims to mean a connection between at least two components wherein one of the components has an opening and the other component has a protrusion extending into the opening, and either the protrusion or the opening has a resiliently deformable portion to allow insertion of the protrusion into the opening as the deformable portion deforms during entry but to deny undesired withdrawal of the protrusion from the opening after the deformable portion resiliently snaps back such that the two components are secured together.

Referring now to the drawings, FIGS. 1–6 show a control pedal assembly 10 for a motor vehicle, such as an automobile, according to the present invention which is selectively adjustable to a desired position by a driver. While the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, air borne vehicles, and water borne vehicles.

The control pedal assembly 10 includes first and second control pedals 12*a*, 12*b* and a control system 13 for selectively adjusting the position of the control pedals 12*a*, 12*b*. In the illustrated embodiment, the control pedals 12*a*, 12*b* are adapted as brake and accelerator pedals respectively. While the illustrated control pedal assembly includes two control pedals 12*a*, 12*b*, it is noted that the control pedal assembly can have a single control pedal within the scope of the present invention such as, for example, a single pedal adapted as a clutch, brake or accelerator pedal. It is also noted that the control pedal assembly can have more than two control pedals within the scope of the present invention such as, for example, three pedals adapted as clutch, brake and accelerator pedals respectively. The control pedals 12*a*, 12*b* are selectively adjustable by the operator in a forward/rearward direction. In multiple pedal embodiments, the control pedals 12*a*, 12*b* are preferably adjusted together simultaneously to maintain desired relationships between the pedals such as, for example, "step over", that is, the forward position of the accelerator pedal 12*b* relative to the brake pedal 12*a* (best shown in FIG. 4). It is noted however, that individual adjustment of each control pedal 12*a*, 12*b* is within the scope of the present invention.

Each pedal assembly is generally the same except as shown in FIGS. 1–6 and as noted herein below. Accordingly, only one control pedal 12*a* will be described in detail. The control pedal 12*a* includes an upper arm 14, a lower arm 16, and a drive assembly 18. The upper arm 14 is sized and shaped for pivotal attachment to a mounting bracket. The mounting bracket is adapted to rigidly attach the adjustable control pedal assembly 10 to a firewall or other rigid structure of the motor vehicle in a known manner. The upper arm 14 is generally an elongate plate oriented in a vertical plane. The illustrated upper arm 14 is generally "L-shaped" having an upper or vertical portion 14*a* which generally vertically extends downward from the mounting bracket and a lower or horizontal portion 14*b* which generally horizontally extends in a rearward direction from a lower end of the upper portion 14*a*.

The upper portion 14*a* of the upper arm 14 is adapted for pivotal attachment to the mounting bracket. The illustrated upper arm 14 has an opening 22 formed for cooperation with the mounting bracket and a pivot pin. With the pivot pin extending through the mounting bracket and the opening 22 of and the upper arm 14, the upper arm 14 is pivotable about a horizontally and laterally extending pivot axis 26 formed by the axis of the pivot pin. The upper arm 14 is operably connected to a control device such as a clutch, brake or throttle such that pivotal movement of the upper arm 14 operates the control device in a desired manner. The upper arm 14 can be connected to the control device by, for example, a push-pull cable for mechanical actuation or electrical wire or cable for electronic signals. The illustrated upper arm 14 is provided with a pin 28 for connection to the control device of a mechanical actuator.

The lower portion 14*b* of the upper arm 14 is adapted for supporting the lower arm 16 and for selected fore and aft movement of the lower arm 16 along the lower portion 14*b* of the upper arm 14. A horizontally extending slot 32 is formed in the lower portion 14*b* of the upper arm 14 and extends the entire thickness of the plate. The lower portion 14*b* is substantially planar or flat in the area of the slot. The slot 32 is adapted for cooperation with the lower arm 16 as described in more detail hereinbelow. The illustrated upper arm 14 includes an insert 34 forming the slot 32 but it is noted that the slot 32 can be formed solely by the plate of the upper arm 14. The insert 34 is formed of any suitable low friction and/or high wear resistant material such as, for example, an acetyl resin such as DELRIN. The insert 32 preferably extends along each side of the upper arm 14 around the entire periphery of the slot 32 to form planar laterally facing bearing surfaces 36, 38 adjacent the slot 32.

The lower arm 16 is sized and shaped for attachment to the upper arm 14 and selected fore and aft movement along the slot 32 of the upper arm 14. The lower arm 16 is generally an elongate plate oriented in a vertical plane so that it is generally a downward extension of the upper arm 14. The lower arm 16 includes a pedal 40 at its lower end and a guide 42 at its upper end. The pedal 40 is adapted for depression by the driver of the motor vehicle to pivot the lower and upper arms 14, 16 about the pivot axis 26 to obtain a desired control input to the motor vehicle. The guide 42 is sized and shaped for cooperation with the slot 32 of the upper arm 14. The illustrated guide 42 is a laterally and horizontally extending tab formed by bending the upper end of the lower arm 16 substantially perpendicular to the main body of the lower arm 16. The guide 42 and the slot 32 are preferably sized to minimize vertical movement of the guide 42 within the slot 32. It is noted that the guide 42 can take many alternative forms within the scope of the present invention such as, for example, the embodiment shown in FIG. 9 and described in more detail hereinbelow. It is also noted that while the illustrated guide 42 is unitary with the main body of the lower arm 16, that is of one piece construction, the guide 42 can alternatively be integrally connected to the main body of the lower arm 16, that is a separate component rigidly secured to the main body of the lower arm 16 such as, for example, the embodiment shown in FIG. 9 and described in more detail hereinbelow.

The guide 42 extends through the slot 32 of the upper arm 14 so that the lower arm 16 is supported by the upper arm 14 by contact of the guide 42 and a bottom bearing surface of the slot 32 and the lower arm 16 is movable fore and aft relative to the upper arm 14 as the guide 42 slides along the bottom bearing surface of the slot 32. The main body of the lower arm 16 engages the bearing surface 36 adjacent the slot 32 on one side of the upper arm 14. Upper and lower bearing members 44, 46 are secured to the free end of the guide 42 on the opposite side of the upper arm 16 and engage the bearing surface 38 adjacent the slot 32 on the other side of the upper arm 14 above and below the slot 32 respectively. The upper and lower bearing members 44, 46 have a first portion for attachment to the guide 42 and a second portion forming a planar bearing surface 48 for engagement with the bearing surface 38 of the upper arm 14. The illustrated upper and lower bearing members 44, 46 are bent plates wherein the first portion is bent substantially perpendicular to the second portion. The lower arm 16 and the upper and lower bearing members 44, 46 are preferably sized to minimize lateral movement, or "side slash", of the guide 42. Assembled in this manner, the guide 42 is held in the slot 32 to secure the lower arm 16 to the upper arm 14 such that the lower arm guide 42 and lower arm 16 are only movable, relative to the upper arm 14, fore and aft along the slot 32.

As best shown in FIGS. 5 and 6, the drive assembly 18 includes a screw shaft or drive screw 50, a drive screw housing or attachment 52 for securing the drive assembly 18 to the upper arm 14, a drive nut 54 adapted for movement along the drive screw 50 in response to rotation of the drive screw 50, a drive nut mounting bracket or attachment 56 for securing the drive assembly 18 to the lower arm 16, an electric motor 58 for rotating the drive screw 50 (best shown in FIGS. 1–4), and a drive cable 60 for connecting the motor 58 to the drive screw 50 (best shown in FIGS. 1–4).

The drive screw 50 is an elongate shaft having a central threaded portion 62 adapted for cooperation with the drive nut 54. The drive screw 50 is preferably formed of resin such as, for example, NYLON but can be alternately formed of a metal such as, for example, steel. The forward end of the drive screw 50 is provided with a bearing surface 66 which cooperates with the drive screw attachment 52 to form a first self-aligning joint 68, that is, to freely permit pivoting of the drive screw 50 relative to the drive screw attachment 52 and the upper arm 14 about at least axes perpendicular to the drive screw rotational axis 64. The first self-aligning joint 68 automatically corrects misalignment of the drive screw 50 and/or the drive nut 54. The illustrated first self aligning joint 68 also forms a snap-fit connection between the drive screw 50 and the drive screw attachment 52. The illustrated bearing surface 66 is generally frusto-spherically shaped and unitary with the drive screw 50. It is noted that the bearing surfaces 66, and thus the first self-aligning joint 68, can have other forms within the scope of the present invention such as, for example, the embodiment shown in FIG. 8 and described in more detail hereinbelow.

Figure 5B:
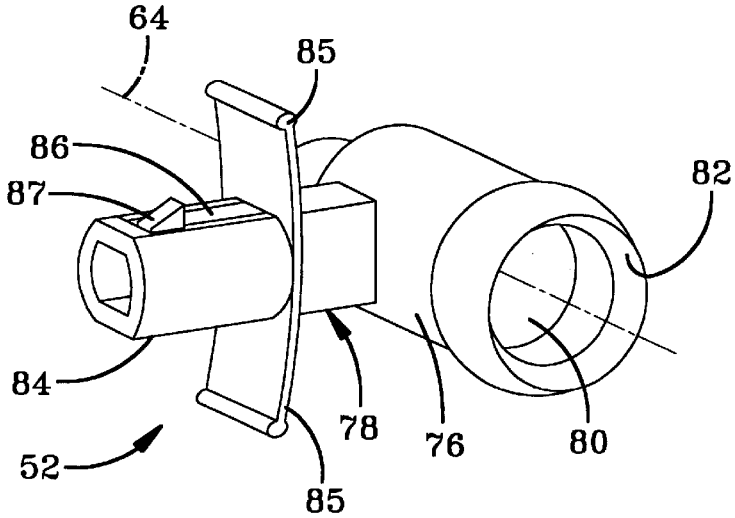
FIG. 5B is a perspective view of a drive screw attachment of the drive assembly of FIG. 5A.

As best shown in FIGS. 5B and 6, the drive screw attachment 52 is sized and shaped for supporting the drive screw 50 and attaching the drive screw 50 to the upper arm 14. The drive screw attachment 52 is preferably molded of a suitable plastic material such as, for example, NYLON but can alternatively be formed of metal such as steel. The drive screw attachment 52 includes a support portion 76 and an attachment portion 78. The support portion 76 is generally tubular-shaped having open ends. The rearward end of the support portion 76 forms a hollow portion or cavity 80 sized and shaped for cooperating the bearing surface 66 of the drive screw 50 to form the first self-aligning joint 68. The cavity 80 forms a bearing surface 82 sized and shaped to cooperate with the bearing surfaces 66 of the drive screw 50. The illustrated bearing surface 82 is a curved groove or race facing the rotational axis 64. The forward end of the support portion 76 is adapted for connection of the drive cable 60 in a known manner.

The attachment portion 78 of the drive screw attachment 52 is adapted for securing the support portion 76 to the upper arm 14. The illustrated attachment portion 78 is adapted as a "snap-in connection" having a tubular body 84 laterally extending from the support portion 76 main body, upper and lower tabs 85 extending from the body 84, and a pair of resiliently deformable fingers 86 carrying abutments 87. The body 84 is sized and shaped to extend through an opening formed in the upper arm 14 located generally above and forward of the slot 32. The tabs 85 are sized and shaped to engage the side of the upper arm 14 to limit insertion of the body 84 into the opening of the upper arm 14. The deformable fingers 86 are sized and shaped so that the fingers 86 are inwardly deflected into the hollow interior of the body 84 as the body 84 is inserted into the opening and resiliently return or spring back upon exiting the opening on the other side of the upper arm 14. Each deformable finger 86 is preferably provided with an angled camming surface to automatically deflect the finger 86 upon insertion of the body 84 into the opening of the upper arm 14. The abutments 87 formed by the fingers 86 are each sized and shaped to prevent undesired withdrawal of the body 84 from the opening of the upper arm 14 by creating an interference against withdrawal. To withdraw the body 84, the fingers 86 are depressed to inwardly move the abutments into the hollow interior of the body 84 and remove the interference.

As best shown in FIGS. 5A and 6, the drive nut 54 is adapted for movement along the drive screw 50 in response to rotation of the drive screw 50. The drive nut 54 is preferably molded of a suitable plastic material such as, for example, NYLON but can alternatively be formed of metal such as, for example steel. The illustrated drive nut 54 is generally "T-shaped" having a horizontally extending and tubular shaped top portion 88 and a vertically extending and tubular shaped bottom portion 89 downwardly extending from the center of the top portion 88. The top portion 88 has an opening extending therethrough which is provided with threads for cooperation with the drive screw 50. The threads can be unitary with the drive nut 54 or formed by an insert secured therein. The bottom portion 89 has a downward facing cavity forming a bearing surface 90 which is sized and shaped for cooperating with the drive nut attachment 56 to form a second self-aligning joint 92, that is, to freely permit pivoting of the drive nut 54 relative to the drive nut attachment 56 about at least axes perpendicular to the rotational axis 64. The illustrated second self-aligning joint 92 is a ball joint which permits pivoting of the drive nut 54 about every axis. The second self-aligning joint 92 automatically corrects misalignment of the drive nut 54 and/or drive screw 50. The illustrated second self aligning joint 92 also forms a snap-fit connection between the drive nut 54 and the drive nut attachment 56. The illustrated bearing surface 90 is generally frusto-spherically shaped. It is noted that the bearing surfaces 90, and thus the second self-aligning joint 92, can have other forms within the scope of the present invention.

The drive nut attachment 56 is sized and shaped for supporting the drive nut 54 and attaching the drive nut 54 to the lower arm 16. The drive nut attachment 56 is preferably molded of a suitable plastic material such as, for example, NYLON but can alternatively be formed of metal such as, for example, steel. The drive nut attachment 56 includes a support portion 93 and an attachment portion 94. The support portion 93 forms a bearing surface 96 for cooperation with the bearing surface 90 of the drive nut 54 as described above. The illustrated bearing surface 96 is a ball joint, that is, a generally frusto-spherically-shaped and is sized and shaped for receipt in the cavity of the drive nut 54 to engage the bearing surface 90 of the drive nut 54. The attachment portion 94 is adapted for securing the support portion 93 to the guide 42 of the lower arm 16. The illustrated attachment portion 96 is a generally cylindrically shaped protrusion which downwardly extends from the support portion 93. The attachment portion 94 is sized and shaped to extend through openings in the lower arm guide 42 and the upper and lower bearing members 44, 46. A collar 98 is preferably provided to limit downward passage of the protrusion 96 through the openings. The protrusion of the attachment portion 94 can be held in position by for example, a cotter pin, spring clip, snap-in fingers or members, or any other suitable method.

As best shown in FIGS. 1–4, the electric motor 58 can be of any suitable type and can be secured to the firewall or other suitable location such as, for example, the mounting bracket of the control pedal 12*a*. The drive cable 60 is preferably a flexible cable and connects the motor 58 and the drive screw 50 so that rotation of the motor 58 rotates the drive screw 50. It is noted that the drive screw 50 and the motor can be alternatively connected with a rigid connection. An input end of the drive cable 60 is connected to an output shaft of the motor 58 and an output end of the drive cable 60 is connected to the end of the drive screw 50. It is noted that suitable gearing is provided between the motor 58 and the drive screw 50 as necessary depending on the requirements of the assembly 10. It is also noted that the fixed portion or sheath of the drive cable 60 is rigidly secured to the forward end of the drive screw attachment 52 and a rotating portion or cable is operatively connected to the forward end of the drive screw 50 to rotate the drive screw 50 therewith.

As best shown in FIGS. 1–6, the illustrated drive assembly 18 also includes a cable support 100 for connecting the drive cable of the 60 of the second control pedal 12*b* to the rearward end of the drive screw 50. Connecting or chaining the drive screws 50 with the electric motor 58 in series enables a single motor 58 to be utilized to adjust multiple control pedals 12*a*, 12*b*. It should be noted that additional control pedals 12*a*, 12*b* can be connected in this manner. It is also noted that if the control pedal assembly 10 has a single control pedal 12*a*, the drive screw 50 is the final control pedal 12*b* of the drive chain, or each control pedal 12*a*, 12*b* is driven by a separate motor 58, the cable support 100 is not necessary.

As best shown in FIGS. 5A and 6, the cable support 100 has a attachment portion 102, a support portion 104, and a connecting portion 106. The attachment portion 102 is generally tubular shaped and adapted to form a "snap fit connection" with the drive screw attachment 52. The illustrated attachment portion is sized and shaped to snap over the rearward end of the drive screw attachment 52 at the first self-aligning joint 68. The support portion 104 is generally tubular shaped and adapted to support the drive cable 60 at the rearward end of the drive screw 50. The connecting portion 106 is sized and shaped to connect the attachment portion 102 and the support portion 104 such that the support portion 104 is supported by the attachment portion 102 in a cantilevered manner. The illustrated connecting portion 106 extends along the drive screw 50 at the lateral side opposite the upper arm to act as a shield or cover for the drive screw 50. Configured in this manner, the drive cable 60 is supported without additional attachment to the upper arm 14.

Figure 7:
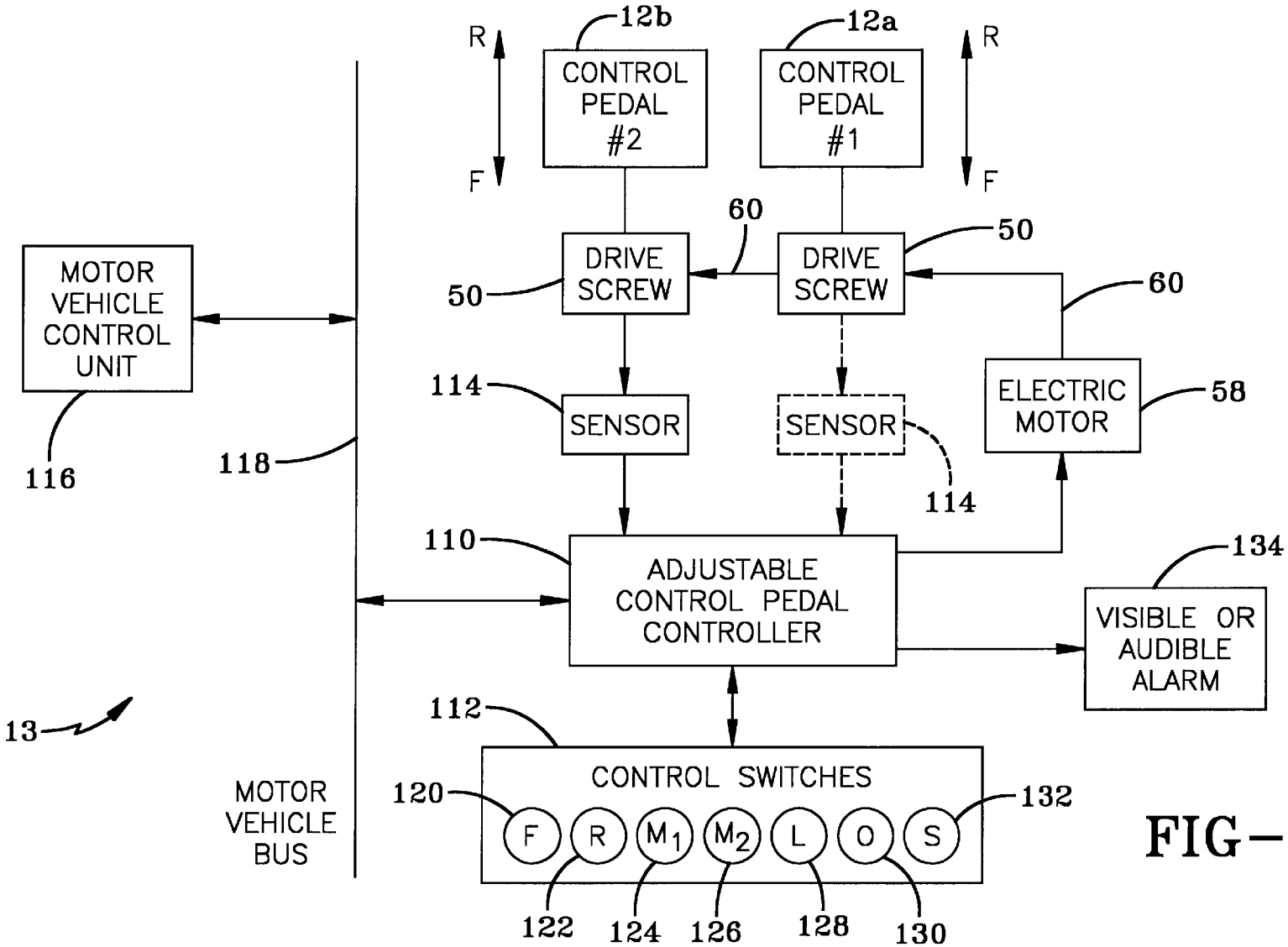
FIG. 7 is a schematic view of a control system for the adjustable control pedal assembly of FIGS. 1–6.

As best shown in FIG. 7, the control system 13 preferably includes a central processing unit (CPU) or controller 110 for activating the motor 58, control switches 112 for inputting information from the driver to the controller 110, and at least one sensor 114 for detecting motion of the control pedals 12*a*, 12*b* such as rotation of the drive screws 50. The control system 13 forms a control loop wherein the controller 110 selectively sends signals to the motor 58 to activate and deactivate the motor 58. When activated, the motor 58 rotates the drive screws 50 through the drive cables 60. The sensor or sensors 14 detect movement of the control pedals 12*a*, 12*b*, such as rotations of the drive screws 50, and sends signals to the controller 110.

The controller 110 includes processing means and memory means which are adapted to control operation of the adjustable control pedal assembly 10. The controller 110 is preferably in communication with a motor vehicle control unit 116 through a local bus 118 of the motor vehicle so that motor vehicle information can be supplied to or examined by the controller 110 and status of the control pedal assembly 10 can be supplied to or examined by the motor vehicle control unit 116. It is noted that while the control system 13 of the illustrated embodiment utilizes a dedicated controller 110, the controller 110 can alternatively be the motor vehicle control unit 116 or can be a controller of another system of the motor vehicle such as, for example, a keyless entry system or a powered seat system.

The control switches 112 are preferably push-button type switches but alternatively can be in many other forms such as, for example, toggle switches. The control switches 112 include at least a forward switch 120 which when activated sends control signals to move the control pedal 40 in a forward direction and a reverse or rearward switch 122 which when activated sends control signals to move the control pedal 40 in a rearward direction. Preferably, the control switches 112 include memory switches 124, 126 which when activated return the control pedal 40 to preferred locations previously saved in memory of the controller 110, a lock out switch 128 which when activated sends control signals preventing movement of the control pedal 40, an override switch 130 which when activated permits the control pedal 40 to be moved by the driver in a desired manner regardless of existing conditions, and a memory save switch 132 which when activated sends a signal to save the current position of the control pedal 40 in memory of the controller 110.

The sensor 114 is adapted to detect movement of the control pedal assembly 10 and send signals relating to such movement to the controller 110. The sensor 114 is preferably located adjacent the drive screw 50 and adapted to detect rotations of the drive screw 50. It is noted that other sensors for detecting motion would be readily apparent to those skilled in the art such as, for example, a sensor for measuring rotation between upper and lower arms. The sensor 114 is preferably a Hall effect device mounted adjacent the drive screw 50 to directly sense each rotation of the drive screw 50 and to send a pulse or signal to the controller 110 for each revolution of the drive screw. Note that the pulses or signals can alternatively be for portions of a revolution or for more than one revolution if desired. The sensor 114 can alternately be another suitable non-contact sensor such as, for example, an inductance sensor, a potentiometer, an encoder, or the like. This rotational information can be utilized by the controller 110 in many ways such as, for example, indicating a system failure when lack of rotation of the drive screw 50 is detected after the controller 110 has sent signals to activate the motor 58, automatically stopping the lower arm 16 at ends of travel along the drive screw 50 using electronic or "soft" stops rather than engaging mechanical or "hard" stops, and returning the control pedal assembly 10 to a stored preferred location when selected by the driver. If the sensor 114 detects a system failure, the control pedal assembly 10 is preferably shut down to prevent any further activation of the motor 58. A visible or audible alarm 134 is preferably provided so that a failure condition can be indicated to the driver. It is noted that if a single sensor 114 is utilized, the sensor is preferably located at the final control pedal 12*b* of the drive chain. It is preferable, however, that each control pedal 12*a*, 12*b* is provided with a sensor 114 so that changes in desired relationships between the control pedals 12*a*, 12*b* can be detected.

As best shown in FIGS. 1–6 the illustrated control pedal assembly 10 can be assembled by first resiliently snapping the drive screw 50 into the drive screw attachment 52 to form the first self-aligning joint 68. The attachment portion 102 of the cable support 100 is placed over the rearward end of the drive screw and the top portion 88 of the drive nut 54 is threaded onto the drive screw 50. The attachment portion 102 of the cable support 100 is resiliently snapped onto the support portion 76 of the drive screw attachment 52 as the rearward end of the drive screw 50 is received into the support portion 104 of the cable support 100. The support portion 93 of the drive nut attachment 56 is resiliently snapped into the bottom portion 89 of the drive nut 54 to form the second self-aligning joint 92. The lower arm guide 42 is inserted through the upper arm slot 32 and the attachment portion 94 of the drive nut attachment 56 is inserted through the lower arm guide 42 and the upper and lower bearing members 44, 46 and secured in place to rigidly secure the drive nut attachment 56 to the lower arm 16. The attachment portion 78 of the drive screw attachment 52 is inserted through the opening in the upper arm 14 and is resiliently snapped in place to rigidly secure the drive screw attachment 52 to the upper arm 14. Secured in this manner, the drive screw 50 is generally parallel to the slot 32, laterally spaced apart from the lower portion 14*a* of the upper arm 14, and located above the upper arm slot 32. It should be noted that while the drive screw 50 of the illustrated embodiment is generally horizontal and parallel with the slot 32, the drive screw 50 can alternatively be mounted generally vertical and perpendicular to the slot 32 along the vertical portion 14*a* of the upper arm 14. Mounted in this manner, a connecting link pivotally connects the lower arm guide 42 and the drive nut 54.

To adjust the control pedal assembly 10, the driver engages the forward or rearward control switch 110, 112 to activate rotation of the motor 58 in the desired direction. Rotation of the motor 58 rotates the drive screw 50 through the drive cable 60 and causes the drive nut 54 to axially move along the drive screw 50 in the desired direction. The drive nut 54 rotates because the drive nut 54 is held against rotation with the drive screw 50 by the drive nut attachment 56. As the drive nut 54 moves along the drive screw 50, the lower arm guide 42 rides along the slot 32 because the lower arm guide 42 is secured to the drive nut 54 through the drive nut attachment 56. It is noted that binding of the drive nut 54 along the drive screw 50 is minimized because the self-aligning joints 68, 92, between the drive screw 50 and its attachment 52 and the drive nut 54 and its attachment 56, automatically align the components so that the drive nut 54 can smoothly travel along the drive screw 50. As the lower arm guide 42 slidingly moves along the upper arm slot 32, the lower arm pedal 40 is linearly moved therewith to adjust the forward/rearward position of the control pedal 40. It can be seen from the above description that activation of the motor 58 changes the position of the lower arm 16 relative to the upper arm 14 but not the position of the upper arm 14 relative to the mounting bracket and therefore does not affect the connection to the control device of the motor vehicle.

Figure 8:
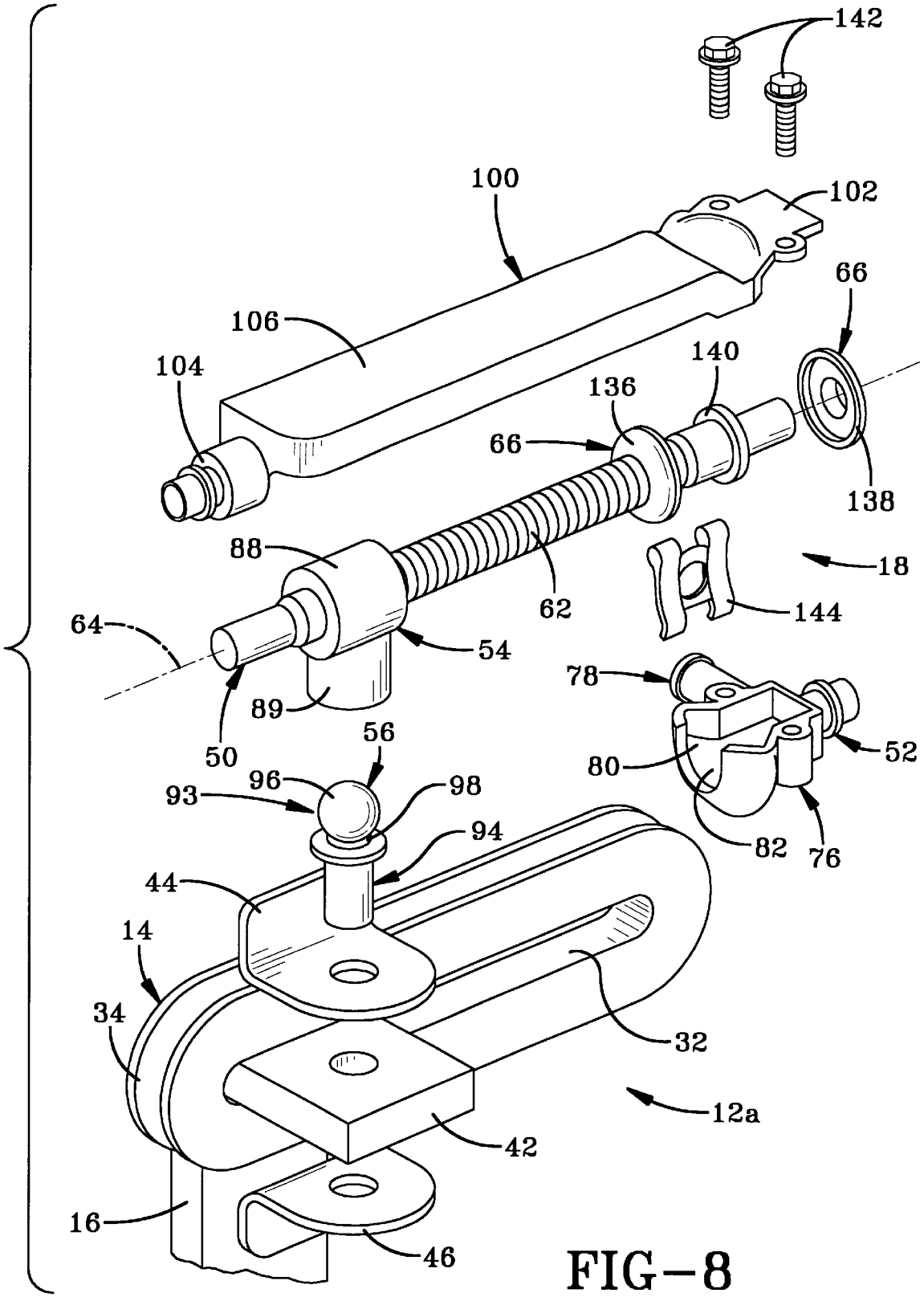
FIG. 8 is an enlarged, fragmented, exploded view similar to FIG. 5A but showing a second embodiment of the adjustable control pedal assembly of FIGS. 1–6.

FIG. 8 illustrates a second embodiment of a control pedal 12*a* for a motor vehicle according to the present invention wherein like reference numbers are used for like structure. The second embodiment is substantially similar to the first embodiment described hereinabove with reference to FIGS. 1–6, except the self-aligning joint 68 between the drive screw 50 and the drive screw attachment 52.

The drive screw 50 is an elongate shaft having a central threaded portion adapted for cooperation with the drive nut 54. The drive screw 50 is preferably formed of a metal such as, for example, steel. The forward end of the drive screw 50 is sized and shaped to cooperate with the drive screw attachment 52 and journal the drive screw 50 for rotation about its rotational axis 64. The forward end of the drive screw 50 is provided with a bearing surface 66 which cooperates with the drive screw attachment to permit rotation of the drive screw 50 about its rotational axis 64 and to form the first self-aligning joint 68, that is, to permit pivoting of the drive screw 50 relative to the drive screw attachment 52 about at least axes perpendicular to the rotational axis 64. The illustrated bearing surface 66 is formed by a pair of bearing members 136, 138 which abut opposite sides of a flange 140 provided on the forward end of the drive screw 50. The illustrated bearing members 136, 138 form generally frusto-conically shaped bearing surfaces 66 facing in opposite directions. It is noted that the bearing surfaces 66, and thus the first self-aligning joint 68, can have other forms within the scope of the present invention.

The drive screw attachment 52 is sized and shaped for supporting the forward end of the drive screw 50 and attaching the drive screw 50 to the upper arm 14. The drive screw attachment 52 is preferably molded of a suitable plastic material such as, for example, NYLON but can alternatively be formed of metal such as, for example, steel. The drive screw attachment 52 includes the support portion 76 and the attachment portion 78. The illustrated drive screw attachment 52 cooperates with the attachment portion 102 of the cable support 100 to act as upper and lower members. The upper and lower members cooperate to form the cavity 80 and the bearing surface 82 of the first self aligning joint 68. The rearward end of the support portion 76 is sized and shaped for supporting the rearward end of the drive screw 50. The connecting portion 106 of the cable support 100 extends above the drive screw 50. The upper member is rigidly secured to the lower member in any suitable manner such as, for example, the illustrated bolts 142. The illustrated attachment portion 78 is a generally tubular shaped protrusion extending from the side of the lower member. The attachment portion 78 is adapted for securing the upper and lower members to the upper arm 14 by laterally extending through an opening in the upper arm 14 and receiving a spring clip 144 or other fastener thereon. It is noted that the attachment portion 78 can alternatively be secured in other manners such as, for example, a "snap fit connection".

Figure 9:
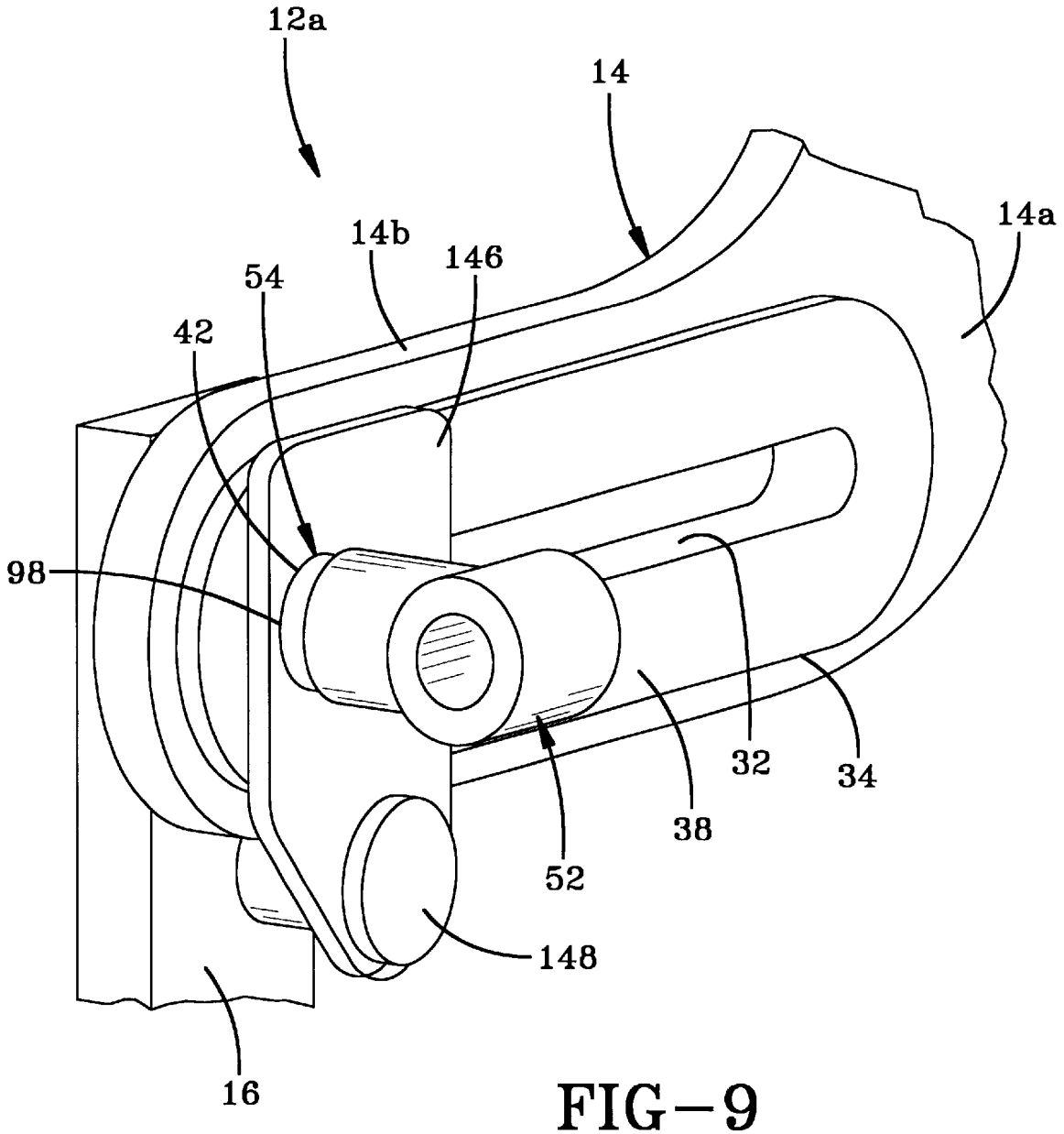
FIG. 9 is a enlarged, fragmented perspective view similar to FIGS. 5A and 8 but showing a third embodiment of the adjustable control pedal assembly of FIGS. 1–6.

FIG. 9 illustrates a third embodiment of a control pedal 12*a* for a motor vehicle according to the present invention wherein like reference numbers are used for like structure. The third embodiment is substantially similar to the first embodiment described hereinabove with reference to FIGS. 1–6, except the connection between the drive nut attachment 54 and the lower arm 16. In the third embodiment, the upper end of the lower arm 16 is generally straight and engages the bearing surface 36 above and below the slot 32 on one side of the upper arm 14. The lower arm guide 42 is formed by the attachment portion 94 (best seen in FIG. 6) of the drive nut attachment 56 which horizontally and laterally extends through the slot 32 to the upper end of the lower arm 16. The third embodiment of the control pedal 12*a* illustrates that the guide 42 can be formed from a separate component and attached to the plate portion of the lower arm 16. A bearing plate 146 is provided between the collar 98 of the drive nut attachment 56 and bearing surface 38 of the upper arm 14. The bearing plate 146 engages the bearing surface 38 above and below the slot 32 on the side of the upper arm 14. Preferably, a guide pin 148 is provided between the bearing plate 146 and the lower arm 16 adjacent the upper arm 14. The illustrated guide pin 148 is located at the bottom edge of the upper arm 14. With the lower arm 16 secured to the drive nut 54 in this manner, lateral and vertical movement of the guide 42 and lower arm 16 relative to the upper arm 14 is prevented but fore and aft movement of the guide 42 and lower arm 16 relative to the upper arm 14 along the slot 32 is permitted. It should be noted that in this embodiment the drive crew 50 is generally parallel to the upper arm slot 32, spaced apart from the upper arm slot 32, and generally facing the upper arm slot 32.

It is noted that each of the features of the above described embodiments can be used in combination with features of the other embodiments as desired depending on the requirements of the particular system. It is apparent from the above description that the present invention provides an adjustable control pedal which eliminates high-precision machined components and weld joints and therefore enables such assemblies to be mass produced at a relatively low cost.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the upper and lower arms can have many different forms. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A control pedal comprising, in combination:

an upper arm having a vertically extending planar portion and a slot in the planar portion;

a screw secured to the upper arm and spaced apart from the planar portion;

a nut threadably engaging the screw and adapted to move axially along the screw upon rotation of the screw;

a motor operatively connected to the screw to selectively rotate the screw;

a lower arm having an upper end extending adjacent the upper arm at a side of said upper arm opposite the nut and a pedal at a lower end; and a guide laterally extending through the slot from the lower arm to the nut, the guide operatively connected to the nut and the lower arm for movement of the guide along the slot and linear fore aft movement of the pedal upon rotation of the screw.

2. The control pedal according to claim 1, wherein the screw is substantially parallel with the slot.

3. The control pedal according to claim 1, wherein the screw is laterally spaced apart from the planar portion.

4. The control pedal according to claim 1, wherein the slot is provided with an insert.

5. The control pedal according to claim 4, wherein the insert has a lower coefficient of friction than the planar portion.

6. The control pedal according to claim 4, wherein the insert extends along sides of the planar portion around at least a portion of the periphery of the slot to form laterally facing bearing surfaces.

7. The control pedal according to claim 6, wherein the lower arm has laterally facing bearing surfaces engaging the bearing surfaces of the insert at each side of the planar portion of the upper arm.

8. The control pedal according to claim 1, wherein the guide is formed by a horizontally extending planar portion of the lower arm.

9. The control pedal according to claim 8, wherein the horizontally extending planar portion of the lower arm is unitary with a vertically extending planar portion of the lower arm.

10. The control pedal according to claim 1, wherein the lower arm has laterally facing bearing surfaces engaging opposite sides of the upper arm planar portion adjacent the slot.

11. The control pedal according to claim 1, wherein the screw is secured to the upper arm through a pivotable joint to align the screw and the nut for the axial movement of the nut along the screw.

12. The control pedal according to claim 1, wherein the lower arm is connected to the nut through a pivotable joint to align the nut and the screw for the axial movement of the nut along the screw.

13. The control pedal according to claim 1, further comprising an attachment securing the screw to the upper arm, wherein one of the upper arm and the attachment has an opening, the other one of the upper arm and the attachment has a protrusion extending into the opening, and the protrusion is adapted to allow insertion of the protrusion into the opening but deny undesired withdrawal of the protrusion from the opening such that the attachment is secured to the upper arm without use of fasteners.

14. The control pedal according to claim 1, wherein the slot forms a bearing surface engaged by the guide to support the lower arm from the upper arm.

15. A control pedal comprising, in combination:

an upper arm;

a screw secured to the upper arm;

a nut threadably engaging the screw and adapted to move axially along the screw upon rotation of the screw, the screw being secured to the upper arm through a pivotable joint to align the screw and the nut for the axial movement of the nut along the screw;

a motor operatively connected to the screw to selectively rotate the screw; and a lower arm carried by the upper arm and having a pedal at a lower end, the lower arm operatively connected to the nut for fore and aft movement of the pedal relative to the upper arm upon rotation of the screw.

16. The control pedal according to claim 15, wherein the screw is freely pivotable relative to the upper arm to self-align the screw and the nut for axial movement of the nut along the screw.

17. The control pedal according to claim 15, wherein the screw is pivotable relative to the upper arm about a plurality of axes generally perpendicular to a rotational axis of the screw.

18. The control pedal according to claim 15, wherein the pivotable joint is a ball/socket joint.

19. The control pedal according to claim 18, wherein the pivotable joint includes a frusto-conically-shaped engagement surface.

20. The control pedal according to claim 18, wherein the pivotable joint includes a frusto-spherically-shaped engagement surface.

21. The control pedal according to claim 18, wherein a ball portion of the ball/socket joint is unitary with the screw.

22. The control pedal according to claim 15, wherein the pivotable joint forms a snap-fit connection.

23. A control pedal comprising, in combination:

an upper arm;

a screw secured to the upper arm;

a nut threadably engaging the screw and adapted to move axially along the screw upon rotation of said screw;

a motor operatively connected to the screw to selectively rotate the screw; and a lower arm carried by the upper arm and having a pedal at a lower end, the lower arm operatively connected to the nut for fore and aft movement of the pedal relative to the upper arm upon rotation of the screw, the lower arm being connected to the nut through a pivotable joint to align the nut and the screw for the axial movement of the nut along the screw.

24. The control pedal according to claim 23, wherein the nut is freely pivotable relative to the lower arm to self-align the screw and the nut for axial movement of the nut along the screw.

25. The control pedal according to claim 23, wherein the nut is pivotable relative to the lower arm about a plurality of axes generally perpendicular to a rotational axis of the screw.

26. The control pedal according to claim 23, wherein the pivotable joint is a ball/socket joint.

27. The control pedal according to claim 26, wherein the pivotable joint includes a frusto-spherically-shaped engagement surface.

28. The control pedal according to claim 26, wherein a socket portion of the ball/socket joint is unitary with the nut.

29. The control pedal according to claim 23, wherein the pivotable joint forms a snap-fit connection.

30. A control pedal comprising, in combination:

an upper arm;

a screw;

an attachment secured to the upper arm and supporting the screw;

a nut threadably engaging the screw and adapted to axially move along the screw upon rotation of the screw;

a motor operatively connected to the screw to selectively rotate the screw;

a lower arm carried by the upper arm and having a pedal at a lower end, the lower arm operatively connected to the nut for fore and aft movement of the pedal relative to the upper arm upon rotation of the screw; and wherein one of the upper arm and the attachment has an opening and the other of the upper arm and the attachment has a protrusion extending into the opening, and one of the opening and the protrusion has a resiliently deformable portion which deforms to a clearance position during insertion of the protrusion into the opening to allow insertion of the protrusion into the opening and resiliently moves From the clearance position to an interference position after insertion of the protrusion onto the opening to deny undesired withdrawal of the protrusion from the opening such that the attachment is secured to the upper arm without use of fasteners.

31. The control pedal according to claim 30, wherein the opening is formed in a vertically extending planar portion of the upper arm.

32. A control pedal comprising, in combination:

an upper arm;

a screw;

an attachment secured to the upper arm and supporting the screw;

a nut threadably engaging the screw and adapted to axially move along the screw upon rotation of the screw;

a motor operatively connected to the screw to selectively rotate the screw;

a lower arm carried by the upper arm and having a pedal at a lower end, the lower arm operatively connected to the nut for fore and aft movement of the pedal relative to the upper arm upon rotation of the screw; and wherein one of the upper arm and the attachment has an opening and the other of the upper arm and the attachment has a protrusion extending into the opening, the protrusion is adapted to allow insertion of the protrusion into the opening but to deny undesired withdrawal of the protrusion from the opening such that the attachment is secured to the upper arm without use of fasteners, the opening is formed in a vertically extending planar portion of the upper arm, at least a portion of the protrusion is resiliently deformable, and the protrusion is provided with at least one resiliently deformable finger.

33. The control pedal according to claim 32, wherein the finger is inwardly deformable toward a central axis of the protrusion.

34. The control pedal according to claim 32, wherein the finger carries an abutment preventing withdrawal of the protrusion from the opening except when the finger is inwardly deformed.

* * * * *